US009528505B2

(12) United States Patent
Hahn et al.

(10) Patent No.: US 9,528,505 B2
(45) Date of Patent: Dec. 27, 2016

(54) LINEAR COMPRESSOR

(71) Applicant: Haier US Appliance Solutions, Inc., Wilmington, DE (US)

(72) Inventors: Gregory William Hahn, Mount Washington, KY (US); Thomas R. Barito, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 201 days.

(21) Appl. No.: 14/177,022

(22) Filed: Feb. 10, 2014

(65) Prior Publication Data

US 2015/0226198 A1 Aug. 13, 2015

(51) Int. Cl.
*F04B 49/00* (2006.01)
*F04B 35/04* (2006.01)

(52) U.S. Cl.
CPC ..... *F04B 35/045* (2013.01)

(58) Field of Classification Search
CPC ..... F04B 35/045; F04B 49/12
See application file for complete search history.

(56) References Cited

U.S. PATENT DOCUMENTS 2,625,954 A * 1/1953 Klein ..... G05D 16/0663 137/505.36
2,882,863 A * 4/1959 Newton ..... F04B 49/08 417/212
3,007,415 A * 11/1961 Bessiere ..... F02M 59/32 417/212
3,195,416 A * 7/1965 Linquist ..... F15B 9/08 137/116.5
3,943,830 A * 3/1976 Sugiura ..... B60T 13/26 92/133
4,002,935 A * 1/1977 Brauer ..... H02K 33/18 310/27
4,300,873 A * 11/1981 Mowbray ..... F02M 57/027 123/467
4,353,220 A * 10/1982 Curwen ..... H02K 33/02 417/214
4,378,199 A * 3/1983 Hesler ..... F24F 11/0001 236/84
5,146,124 A * 9/1992 Higham ..... F16F 7/116 310/17
5,318,412 A * 6/1994 Laskaris ..... F04B 35/045 417/417
5,392,807 A * 2/1995 Caudle ..... F16K 31/1221 137/316
5,525,845 A * 6/1996 Beale ..... F02G 1/0435 310/12.27

(Continued)

FOREIGN PATENT DOCUMENTS

EP 0620367 4/1993
GB 1517644 A * 7/1978 ..... F04B 49/08

(Continued)

*Primary Examiner* — Charles Freay
(74) *Attorney, Agent, or Firm* — Dority & Manning, P.A.

(57) ABSTRACT

A linear compressor and a method for operating a linear compressor are provided. The linear compressor includes a casing and a machined spring. An inner back iron assembly is fixed to the machined spring at a middle portion of the machined spring. The linear compressor also includes features for adjusting a length of the machined spring.

13 Claims, 6 Drawing Sheets

(56) References Cited

U.S. PATENT DOCUMENTS 5,944,302 A * 8/1999 Loc ..... F04B 35/045 267/180
6,231,310 B1 * 5/2001 Tojo ..... F04B 35/045 417/417
6,398,523 B1 * 6/2002 Hur ..... F04B 39/0055 417/312
6,676,388 B2 * 1/2004 Lee ..... F04B 35/045 417/415
6,812,597 B2 * 11/2004 McGill ..... F04B 35/045 310/12.19
6,835,052 B2 * 12/2004 Kim ..... F04B 39/102 417/552
6,860,725 B2 * 3/2005 Park ..... F04B 35/045 181/212
6,875,001 B2 * 4/2005 Song ..... F04B 35/045 417/416
6,913,450 B2 * 7/2005 Hong ..... F04B 35/045 137/315.33
6,946,754 B2 * 9/2005 Inagaki ..... H02K 33/16 310/12.25
6,960,067 B2 * 11/2005 Jung ..... F04B 35/045 310/14
7,025,575 B2 * 4/2006 Noh ..... F04B 35/045 417/363
7,249,938 B2 * 7/2007 Noh ..... F04B 35/045 128/204.18
7,287,966 B2 * 10/2007 French ..... F02M 51/04 417/416
7,306,438 B2 * 12/2007 Kang ..... F04B 35/045 181/229
7,614,856 B2 * 11/2009 Inagaki ..... F04B 35/045 267/136
7,618,243 B2 * 11/2009 Tian ..... F04B 35/045 417/417
7,626,289 B2 * 12/2009 Her ..... F04B 35/045 310/12.04
7,753,657 B2 * 7/2010 Strauss ..... F02D 41/20 123/497
7,868,566 B2 * 1/2011 Bechtold ..... F04B 35/045 318/135
7,921,845 B2 * 4/2011 Kim ..... F04B 35/045 128/204.18
8,011,183 B2 9/2011 Berchowitz
8,127,560 B2 * 3/2012 Dicken ..... F16F 1/125 60/520
8,177,523 B2 * 5/2012 Patel ..... F04B 35/045 29/596
8,241,015 B2 * 8/2012 Lillie ..... F04B 35/045 417/363
8,303,273 B2 * 11/2012 Kang ..... F04B 39/0088 417/416
8,360,749 B2 * 1/2013 Morrone ..... F04B 35/045 29/890.035
8,998,589 B2 * 4/2015 Lilie ..... F04B 35/045 417/410.1
2002/0182085 A1 * 12/2002 Kawata ..... F16D 7/048 417/212
2003/0103848 A1 * 6/2003 Hayashi ..... F04B 27/0895 417/212
2005/0025638 A1 * 2/2005 Buffet ..... F04B 17/046 417/416
2005/0047941 A1 * 3/2005 Humburg ..... F04B 17/046 417/416
2005/0118043 A1 * 6/2005 Liu ..... F04B 17/04 417/415
2006/0171822 A1 * 8/2006 Seagar ..... F04B 35/045 417/410.1
2009/0039655 A1 * 2/2009 Berchowitz ..... F02G 1/043 290/1 A
2009/0058200 A1 * 3/2009 Rockelein ..... H02K 33/16 310/12.24
2009/0094977 A1 * 4/2009 Hill ..... F02G 1/053 60/520
2009/0232666 A1 * 9/2009 Choi ..... F04B 35/045 417/212
2009/0263262 A1 * 10/2009 McGill ..... F04B 35/045 417/415
2009/0280015 A1 * 11/2009 Lillie ..... F04B 35/045 417/416
2009/0304525 A1 * 12/2009 Reinschke ..... F04B 35/045 417/53
2010/0008794 A1 * 1/2010 Rush ..... A61M 5/14216 417/53
2010/0047079 A1 * 2/2010 Reinschke ..... H02P 25/06 417/44.1
2011/0056196 A1 * 3/2011 Berchowitz ..... F02G 1/0435 60/517
2011/0058960 A1 * 3/2011 Bernhard Lilie ..... F04B 35/045 417/63
2011/0135518 A1 * 6/2011 Kang ..... F04B 35/045 417/417
2012/0039726 A1 * 2/2012 Fritzer ..... F15B 11/055 417/53
2012/0177513 A1 * 7/2012 Lilie ..... F04B 35/045 417/417
2012/0282115 A1 * 11/2012 Du ..... F04B 23/06 417/53
2013/0156612 A1 * 6/2013 Bonnefoi ..... F04C 29/021 417/212
2014/0072461 A1 * 3/2014 Barito ..... F04B 35/045 417/415
2014/0072462 A1 * 3/2014 Filippa ..... F04B 35/045 417/415
2014/0234145 A1 * 8/2014 Roman ..... F04B 35/045 417/481
2014/0301874 A1 * 10/2014 Roettger ..... F04B 35/045 417/437
2014/0326129 A1 * 11/2014 Schreuder ..... F15B 15/226 92/133
2015/0226194 A1 * 8/2015 Barito ..... F04B 39/0005 417/417
2015/0226195 A1 * 8/2015 Mallampalli ..... F04B 49/06 417/44.1
2015/0226196 A1 * 8/2015 Barito ..... F04B 35/045 417/363
2015/0226197 A1 * 8/2015 Hahn ..... F04B 35/045 417/363
2015/0226198 A1 * 8/2015 Hahn ..... F04B 35/045 417/53
2015/0226199 A1 * 8/2015 Barito ..... F04B 35/04 417/363
2015/0226200 A1 * 8/2015 Beers ..... F04B 39/0005 417/416
2015/0226201 A1 * 8/2015 Beers ..... F04B 35/045 417/363
2015/0226202 A1 * 8/2015 Beers ..... F04B 39/0005 417/363
2015/0226203 A1 * 8/2015 Hahn ..... F04B 35/045 417/415
2015/0226210 A1 * 8/2015 Barito ..... F04B 35/045 417/415

FOREIGN PATENT DOCUMENTS

KR WO 2010016700 A1 * 2/2010 ..... F04B 17/04
WO WO 2005/028841 3/2005
WO WO 2006/013377 2/2006
WO WO 2006/081642 2/2006
WO WO 2013/003923 1/2013

* cited by examiner

LINEAR COMPRESSOR

FIELD OF THE INVENTION

The present subject matter relates generally to linear compressors, e.g., for refrigerator appliances.

BACKGROUND OF THE INVENTION

Certain refrigerator appliances include sealed systems for cooling chilled chambers of the refrigerator appliance. The sealed systems generally include a compressor that generates compressed refrigerant during operation of the sealed system. The compressed refrigerant flows to an evaporator where heat exchange between the chilled chambers and the refrigerant cools the chilled chambers and food items located therein.

Recently, certain refrigerator appliances have included linear compressors for compressing refrigerant. Linear compressors generally include a piston and a driving coil. The driving coil receives a current that generates a force for sliding the piston forward and backward within a chamber. During motion of the piston within the chamber, the piston compresses refrigerant.

Depending upon a compressed refrigerant demand, linear compressors can operate at various capacities. During low capacity operations, the driving coil displaces the piston less than during high capacity operations. Thus, a stroke of the piston can be shorter and head clearances can be larger during low capacity operations compared to high capacity operations. The shorter strokes and larger head clearances during low capacity operations can decrease a volumetric and overall efficiency of the linear compressor.

Accordingly, a linear compressor with features for improving an efficiency of the linear compressor during low capacity operations would be useful.

In linear compressors, the driving coil generally engages a magnet on a mover assembly of the linear compressor in order to reciprocate the piston within the chamber. The magnet is spaced apart from the driving coil by an air gap. In certain linear compressors, an additional air gap is provided at an opposite side of the magnet, e.g., between the magnet and an inner back iron of the linear compressor. However, multiple air gaps can negatively affect operation of the linear compressor by interrupting transmission of a magnetic field from the driving coil. In addition, maintaining a uniform air gap between the magnet and the driving coil and/or inner back iron can be difficult.

Accordingly, a linear compressor with features for maintaining uniformity of an air gap between a magnet and a driving coil of the linear compressor would be useful. In particular, a linear compressor having only a single air gap would be useful.

BRIEF DESCRIPTION OF THE INVENTION

The present subject matter provides a linear compressor and a method for operating a linear compressor. The linear compressor includes a casing and a machined spring. An inner back iron assembly is fixed to the machined spring at a middle portion of the machined spring. The linear compressor also includes features for adjusting a length of the machined spring. Additional aspects and advantages of the invention will be set forth in part in the following description, or may be apparent from the description, or may be learned through practice of the invention.

In a first exemplary embodiment, a linear compressor is provided. The linear compressor includes a cylinder assembly that defines a chamber and a piston slidably received within the chamber of the cylinder assembly. The linear compressor also includes a driving coil. An inner back iron assembly is positioned in the driving coil. The inner back iron assembly extends between a first end portion and a second end portion. The inner back iron assembly includes an outer cylinder and a sleeve. The outer cylinder has an outer surface. A magnet is mounted to the inner back iron assembly at the outer surface of the inner back iron assembly such that the magnet faces the driving coil. The linear compressor also includes a machined spring. The machined spring includes a first cylindrical portion positioned adjacent the first end portion of the inner back iron assembly. A second cylindrical portion is positioned within and fixed to the inner back iron assembly. A first helical portion extends between and couples the first and second cylindrical portions together. A third cylindrical portion is positioned adjacent the second end portion of the inner back iron assembly. A second helical portion extends between and couples the second and third cylindrical portions together. The linear compressor further includes means for adjusting a position of the first cylindrical portion of the machined spring relative to the third cylindrical portion of the machined spring.

In a second exemplary embodiment, a linear compressor is provided. The linear compressor defines a radial direction, a circumferential direction and an axial direction. The linear compressor includes a cylinder assembly that defines a chamber and a piston received within the chamber of the cylinder assembly such that the piston is slidable along a first axis within the chamber of the cylinder assembly. The linear compressor also includes a machined spring. An inner back iron assembly extends about the machined spring along the circumferential direction. The inner back iron assembly is fixed to the machined spring at a middle portion of the machined spring. A driving coil extends about the inner iron assembly along the circumferential direction. The driving coil is operable to move the inner back iron assembly along a second axis. The first and second axes are substantially parallel to the axial direction. A magnet is mounted to the inner back iron assembly such that the magnet is spaced apart from the driving coil by an air gap along the radial direction. The linear compressor further includes means for adjusting a length of the machined spring along the axial direction.

In a third exemplary embodiment, a method for operating a linear compressor is provided. The method includes activating a motor of the linear compressor in order to reciprocate a mover of the linear compressor within the motor. The mover is suspended in the motor with a machined spring. The method also includes directing compressed discharge fluid from a cylinder of the linear compressor into an enclosed volume defined by the machined spring and a casing of the linear compressor. The compressed discharge fluid urges an end of the machined spring from a first position towards a second position. A length of the machined spring is a first length when the end of the machined spring is in the first position. The length of the machined spring is a second length when the end of the machined spring is in the second position. The first and second lengths are different.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
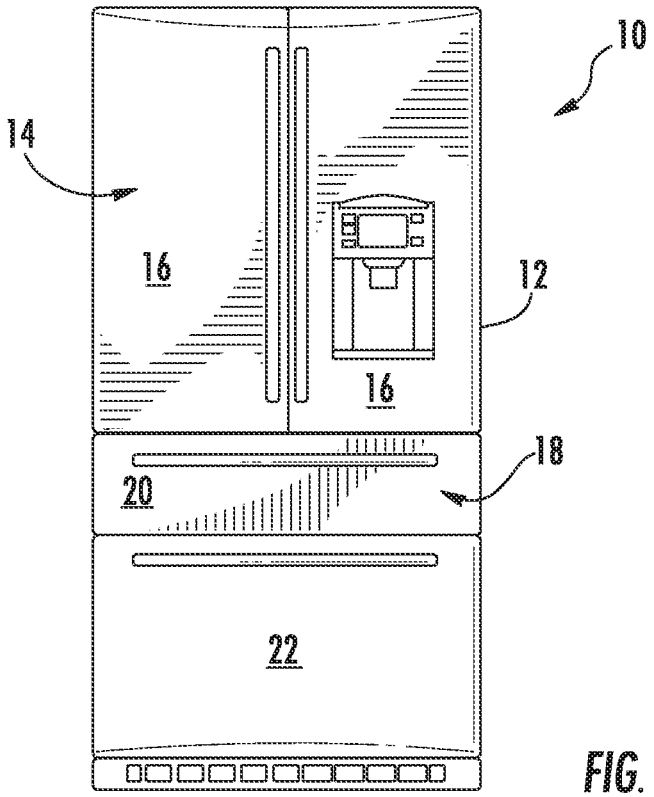
FIG. 1 is a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
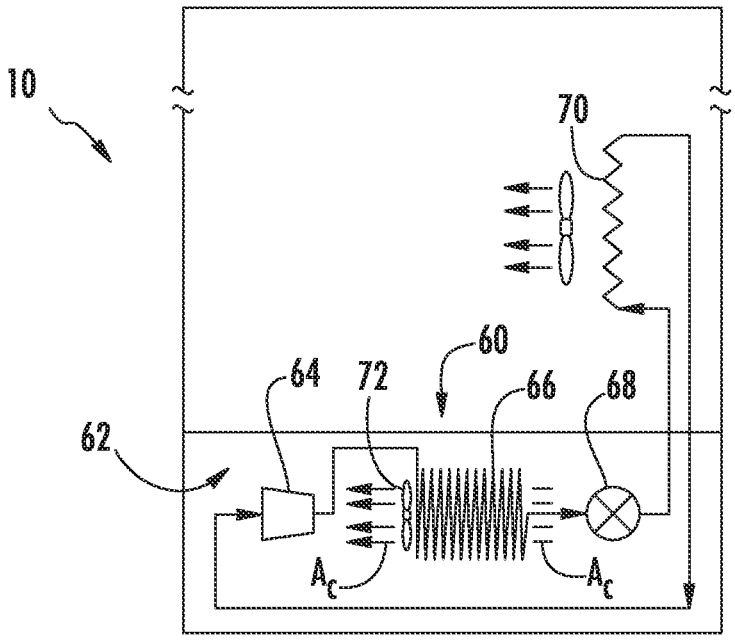
FIG. 2 is schematic view of certain components of the exemplary refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as vapor compression within air conditioning units or air compression within air compressors.

In the illustrated exemplary embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 64, a condenser 66, an expansion device 68, and an evaporator 70 connected in series and charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A fan 72 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well.

Figure 3:
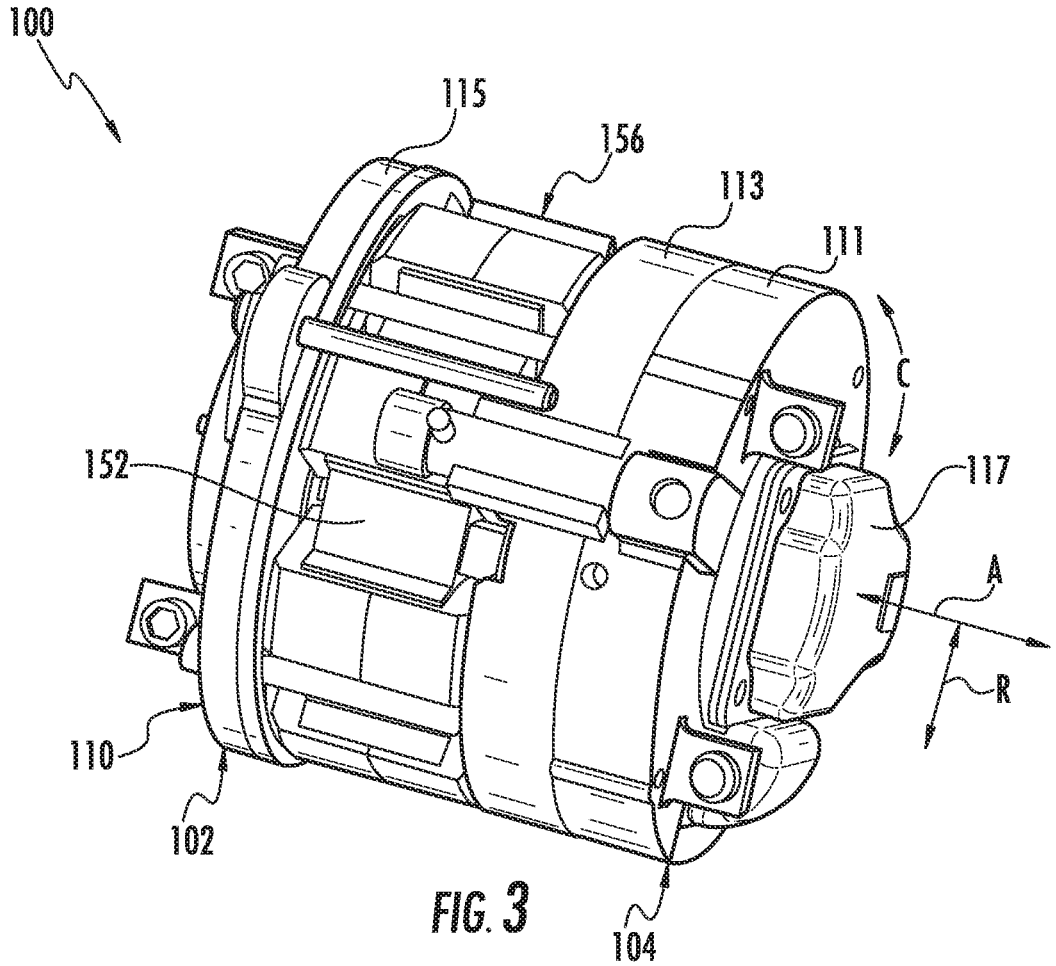
FIG. 3 provides a perspective view of a linear compressor according to an exemplary embodiment of the present subject matter.
Figure 4:
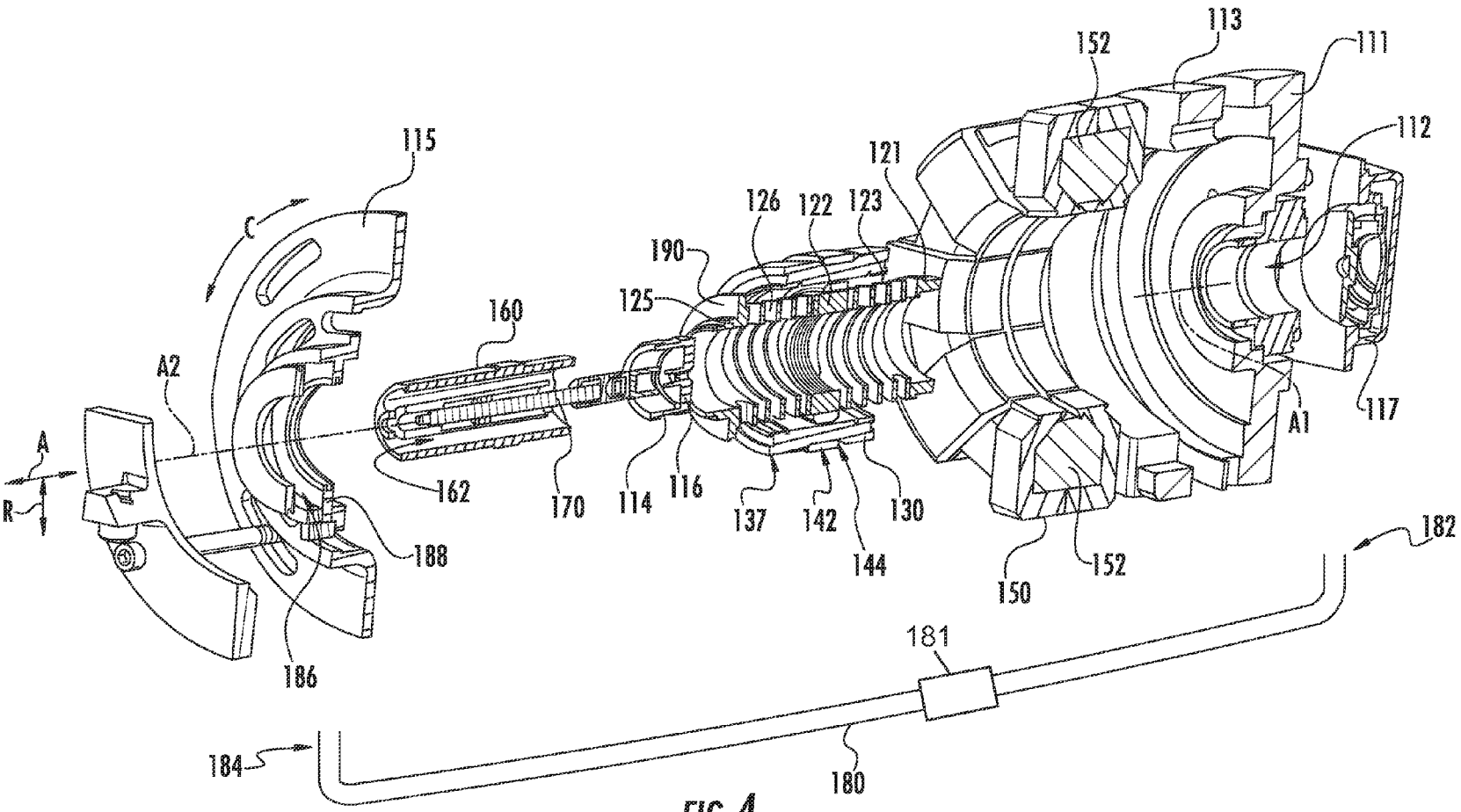
FIG. 4 provides an exploded, section view of the exemplary linear compressor of FIG. 3.
Figure 5:
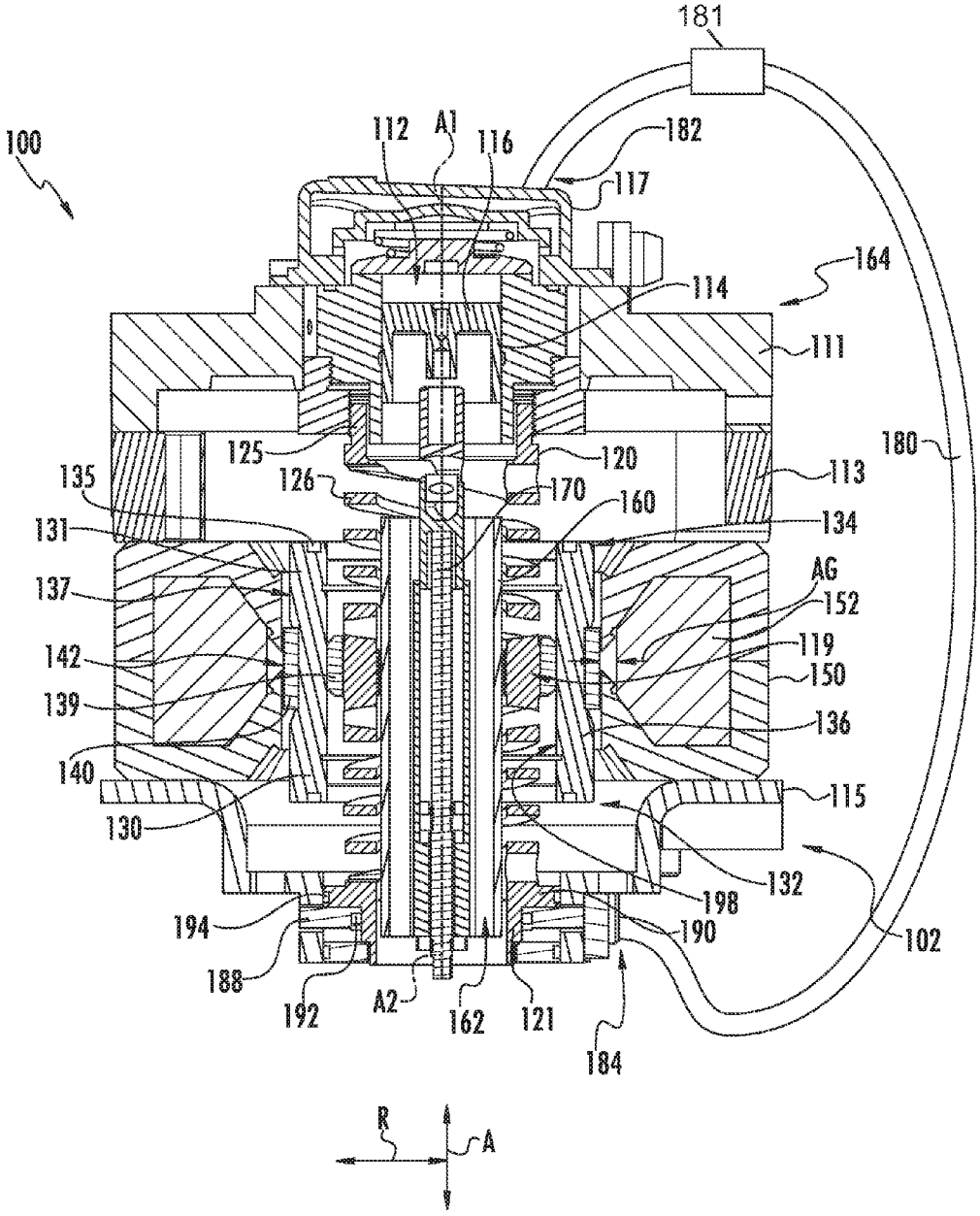
FIGS. 5 and 6 provide side section views of the exemplary linear compressor of FIG. 3 with a machined spring of the exemplary linear compressor shown in various configurations.

FIG. 3 provides a perspective view of a linear compressor 100 according to an exemplary embodiment of the present subject matter. FIG. 4 provides a side section view of linear compressor 100. FIG. 5 provides an exploded side section view of linear compressor 100. As discussed in greater detail below, linear compressor 100 is operable to increase a pressure of fluid within a chamber 112 of linear compressor 100. Linear compressor 100 may be used to compress any suitable fluid, such as refrigerant or air. In particular, linear compressor 100 may be used in a refrigerator appliance, such as refrigerator appliance 10 (FIG. 1) in which linear compressor 100 may be used as compressor 64 (FIG. 2). As may be seen in FIG. 3, linear compressor 100 defines an axial direction A, a radial direction R and a circumferential direction C. Linear compressor 100 may be enclosed within a hermetic or air-tight shell (not shown). The hermetic shell can, e.g., hinder or prevent refrigerant from leaking or escaping from refrigeration system 60.

Turning now to FIG. 4, linear compressor 100 includes a casing 110 that extends between a first end portion 102 and a second end portion 104, e.g., along the axial direction A. Casing 110 includes various static or non-moving structural components of linear compressor 100. In particular, casing 110 includes a cylinder assembly 111 that defines a chamber 112. Cylinder assembly 111 is positioned at or adjacent second end portion 104 of casing 110. Chamber 112 extends longitudinally along the axial direction A. Casing 110 also includes a motor mount mid-section 113 and an end cap 115 positioned opposite each other about a motor. A stator, e.g., including an outer back iron 150 and a driving coil 152, of the motor is mounted or secured to casing 110, e.g., such that the stator is sandwiched between motor mount mid-section 113 and end cap 115 of casing 110. Linear compressor 100 also includes valves (such as a discharge valve assembly 117 at an end of chamber 112) that permit refrigerant to enter and exit chamber 112 during operation of linear compressor 100.

A piston assembly 114 with a piston head 116 is slidably received within chamber 112 of cylinder assembly 111. In particular, piston assembly 114 is slidable along a first axis A1 within chamber 112. The first axis A1 may be substantially parallel to the axial direction A. During sliding of piston head 116 within chamber 112, piston head 116 compresses refrigerant within chamber 112. As an example, from a top dead center position, piston head 116 can slide within chamber 112 towards a bottom dead center position along the axial direction A, i.e., an expansion stroke of piston head 116. When piston head 116 reaches the bottom dead center position, piston head 116 changes directions and slides in chamber 112 back towards the top dead center position, i.e., a compression stroke of piston head 116. It should be understood that linear compressor 100 may include an additional piston head and/or additional chamber at an opposite end of linear compressor 100. Thus, linear compressor 100 may have multiple piston heads in alternative exemplary embodiments.

Linear compressor 100 also includes an inner back iron assembly 130. Inner back iron assembly 130 is positioned in the stator of the motor. In particular, outer back iron 150 and/or driving coil 152 may extend about inner back iron assembly 130, e.g., along the circumferential direction C. Inner back iron assembly 130 extends between a first end portion 132 and a second end portion 134, e.g., along the axial direction A.

Inner back iron assembly 130 also has an outer surface 137. At least one driving magnet 140 is mounted to inner back iron assembly 130, e.g., at outer surface 137 of inner back iron assembly 130. Driving magnet 140 may face and/or be exposed to driving coil 152. In particular, driving magnet 140 may be spaced apart from driving coil 152, e.g., along the radial direction R by an air gap AG. Thus, the air gap AG may be defined between opposing surfaces of driving magnet 140 and driving coil 152. Driving magnet 140 may also be mounted or fixed to inner back iron assembly 130 such that an outer surface 142 of driving magnet 140 is substantially flush with outer surface 137 of inner back iron assembly 130. Thus, driving magnet 140 may be inset within inner back iron assembly 130. In such a manner, the magnetic field from driving coil 152 may have to pass through only a single air gap (e.g., air gap AG) between outer back iron 150 and inner back iron assembly 130 during operation of linear compressor 100, and linear compressor 100 may be more efficient than linear compressors with air gaps on both sides of a driving magnet.

As may be seen in FIG. 4, driving coil 152 extends about inner back iron assembly 130, e.g., along the circumferential direction C. Driving coil 152 is operable to move the inner back iron assembly 130 along a second axis A2 during operation of driving coil 152. The second axis may be substantially parallel to the axial direction A and/or the first axis A1. As an example, driving coil 152 may receive a current from a current source (not shown) in order to generate a magnetic field that engages driving magnet 140 and urges piston assembly 114 to move along the axial direction A in order to compress refrigerant within chamber 112 as described above and will be understood by those skilled in the art. In particular, the magnetic field of driving coil 152 may engage driving magnet 140 in order to move inner back iron assembly 130 along the second axis A2 and piston head 116 along the first axis A1 during operation of driving coil 152. Thus, driving coil 152 may slide piston assembly 114 between the top dead center position and the bottom dead center position, e.g., by moving inner back iron assembly 130 along the second axis A2, during operation of driving coil 152.

Linear compressor 100 may include various components for permitting and/or regulating operation of linear compressor 100. In particular, linear compressor 100 includes a controller (not shown) that is configured for regulating operation of linear compressor 100. The controller is in, e.g., operative, communication with the motor, e.g., driving coil 152 of the motor. Thus, the controller may selectively activate driving coil 152, e.g., by supplying current to driving coil 152, in order to compress refrigerant with piston assembly 114 as described above.

The controller includes memory and one or more processing devices such as microprocessors, CPUs or the like, such as general or special purpose microprocessors operable to execute programming instructions or micro-control code associated with operation of linear compressor 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Linear compressor 100 also includes a machined spring 120. Machined spring 120 is positioned in inner back iron assembly 130. In particular, inner back iron assembly 130 may extend about machined spring 120, e.g., along the circumferential direction C. Machined spring 120 also extends between first and second end portions 102 and 104 of casing 110, e.g., along the axial direction A. Machined spring 120 assists with coupling inner back iron assembly 130 to casing 110, e.g., cylinder assembly 111 of casing 110. In particular, inner back iron assembly 130 is fixed to machined spring 120 at a middle portion 119 of machined spring 120 as discussed in greater detail below.

During operation of driving coil 152, machined spring 120 supports inner back iron assembly 130. In particular, inner back iron assembly 130 is suspended by machined spring 120 within the stator of the motor such that motion of inner back iron assembly 130 along the radial direction R is hindered or limited while motion along the second axis A2 is relatively unimpeded. Thus, machined spring 120 may be substantially stiffer along the radial direction R than along the axial direction A. In such a manner, machined spring 120 can assist with maintaining a uniformity of the air gap AG between driving magnet 140 and driving coil 152, e.g., along the radial direction R, during operation of the motor and movement of inner back iron assembly 130 on the second axis A2. Machined spring 120 can also assist with hindering side pull forces of the motor from transmitting to piston assembly 114 and being reacted in cylinder assembly 111 as a friction loss.

Figure 6:
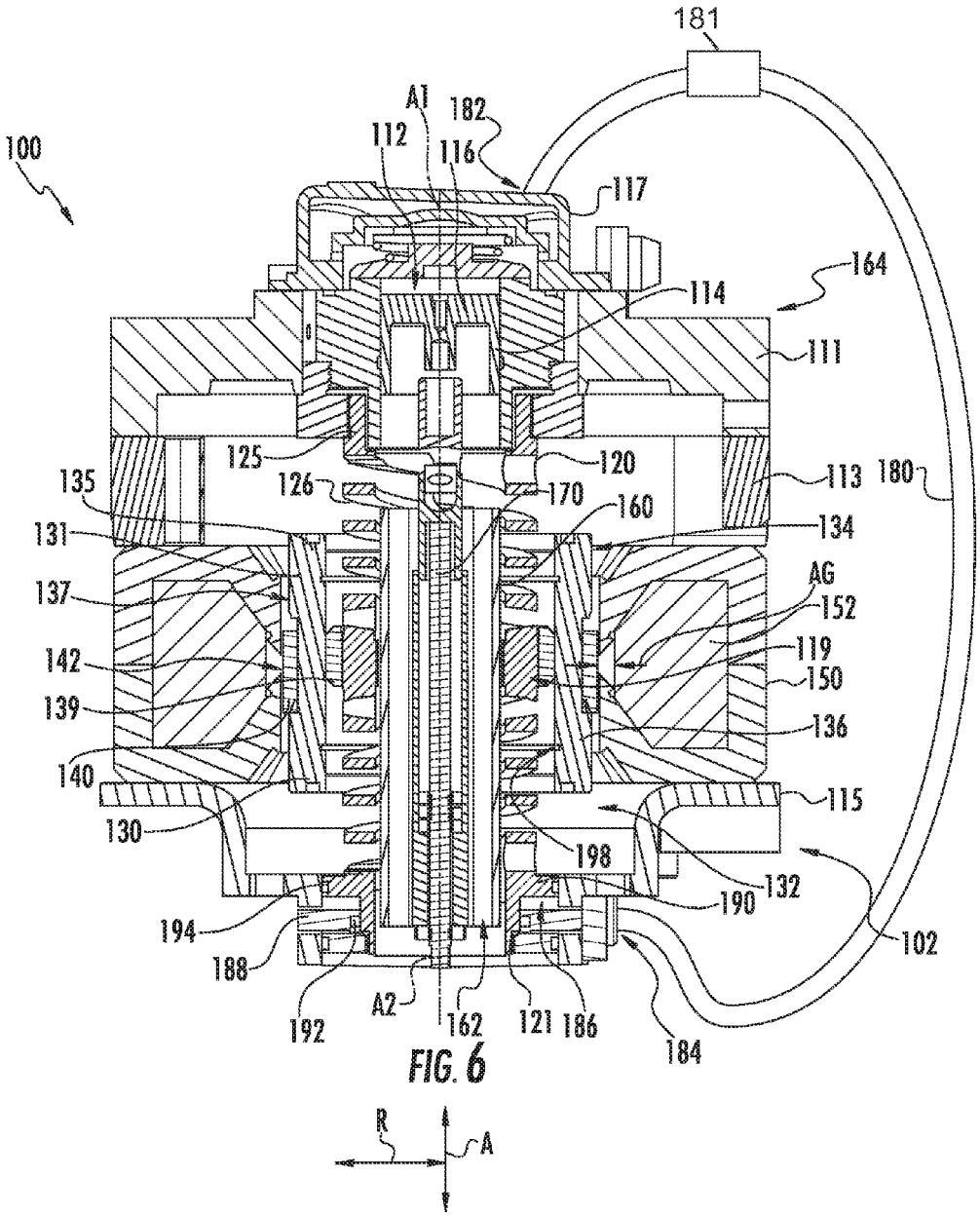

As may be seen in FIGS. 5 and 6, inner back iron assembly 130 includes an outer cylinder 136 and a sleeve 139. Outer cylinder 136 defines outer surface 137 of inner back iron assembly 130 and also has an inner surface 138 positioned opposite outer surface 137 of outer cylinder 136. Sleeve 139 is positioned on or at inner surface 138 of outer cylinder 136. A first interference fit between outer cylinder 136 and sleeve 139 may couple or secure outer cylinder 136 and sleeve 139 together. In alternative exemplary embodiments, sleeve 139 may be welded, glued, fastened, or connected via any other suitable mechanism or method to outer cylinder 136. Sleeve 139 may be constructed of or with any suitable material. For example, sleeve 139 may be a cylindrical piece of metal, such as steel, in certain exemplary embodiments.

Sleeve 139 extends about machined spring 120, e.g., along the circumferential direction C. In addition, middle portion 119 of machined spring 120 (e.g., third cylindrical portion 125) is mounted or fixed to inner back iron assembly 130 with sleeve 139. As may be seen in FIGS. 5 and 6, sleeve 139 extends between inner surface 138 of outer cylinder 136 and middle portion 119 of machined spring 120, e.g., along the radial direction R. In particular, sleeve 139 extends between inner surface 138 of outer cylinder 136 and second cylindrical portion 122 of machined spring 120, e.g., along the radial direction R. A second interference fit between sleeve 139 and middle portion 119 of machined spring 120 may couple or secure sleeve 139 and middle portion 119 of machined spring 120 together. In alternative exemplary embodiments, sleeve 139 may be welded, glued, fastened, or connected via any other suitable mechanism or method to middle portion 119 of machined spring 120 (e.g., second cylindrical portion 122 of machined spring 120).

Outer cylinder 136 may be constructed of or with any suitable material. For example, outer cylinder 136 may be constructed of or with a plurality of (e.g., ferromagnetic) laminations 131. Laminations 131 are distributed along the circumferential direction C in order to form outer cylinder 136. Laminations 131 are mounted to one another or secured together, e.g., with rings 135 at first and second end portions 132 and 134 of inner back iron assembly 130. Outer cylinder 136, e.g., laminations 131, define a recess 144 that extends inwardly from outer surface 137 of outer cylinder 136, e.g., along the radial direction R. Driving magnet 140 is positioned in recess 144, e.g., such that driving magnet 140 is inset within outer cylinder 136.

A piston flex mount 160 is mounted to and extends through inner back iron assembly 130. In particular, piston flex mount 160 is mounted to inner back iron assembly 130 via sleeve 139 and machined spring 120. Thus, piston flex mount 160 may be coupled (e.g., threaded) to machined spring 120 at second cylindrical portion 122 of machined spring 120 in order to mount or fix piston flex mount 160 to inner back iron assembly 130. A flexible or compliant coupling 170 extends between piston flex mount 160 and piston assembly 114, e.g., along the axial direction A. Thus, compliant coupling 170 connects inner back iron assembly 130 and piston assembly 114 such that motion of inner back iron assembly 130, e.g., along the axial direction A or the second axis A2, is transferred to piston assembly 114.

Compliant coupling 170 extends between a first end portion and a second end portion, e.g., along the axial direction A. The first end portion of compliant coupling 170 is mounted to the piston flex mount 160, and the second end portion of compliant coupling 170 is mounted to piston assembly 114. The first and second end portions and of compliant coupling 170 may be positioned at opposite sides of driving coil 152. In particular, compliant coupling 170 may extend through driving coil 152, e.g., along the axial direction A.

As discussed above, compliant coupling 170 may extend between inner back iron assembly 130 and piston assembly 114, e.g., along the axial direction A, and connect inner back iron assembly 130 and piston assembly 114 together. In particular, compliant coupling 170 transfers motion of inner back iron assembly 130 along the axial direction A to piston assembly 114. However, compliant coupling 170 is compliant or flexible along the radial direction R. In particular, compliant coupling 170 may be sufficiently compliant along the radial direction R such little or no motion of inner back iron assembly 130 along the radial direction R is transferred to piston assembly 114 by compliant coupling 170. In such a manner, side pull forces of the motor are decoupled from piston assembly 114 and/or cylinder assembly 111 and friction between position assembly 114 and cylinder assembly 111 may be reduced.

Piston flex mount 160 defines at least one passage 162. Passage 162 of piston flex mount 160 extends, e.g., along the axial direction A, through piston flex mount 160. Thus, a flow of fluid, such as air or refrigerant, may pass though piston flex mount 160 via passage 162 of piston flex mount 160 during operation of linear compressor 100.

Piston head 116 also defines at least one opening (not shown). The opening of piston head 116 extends, e.g., along the axial direction A, through piston head 116. Thus, the flow of fluid may pass though piston head 116 via the opening of piston head 116 into chamber 112 during operation of linear compressor 100. In such a manner, the flow of fluid (that is compressed by piston head 114 within chamber 112) may flow through piston flex mount 160 and inner back iron assembly 130 to piston assembly 114 during operation of linear compressor 100.

Figure 7:
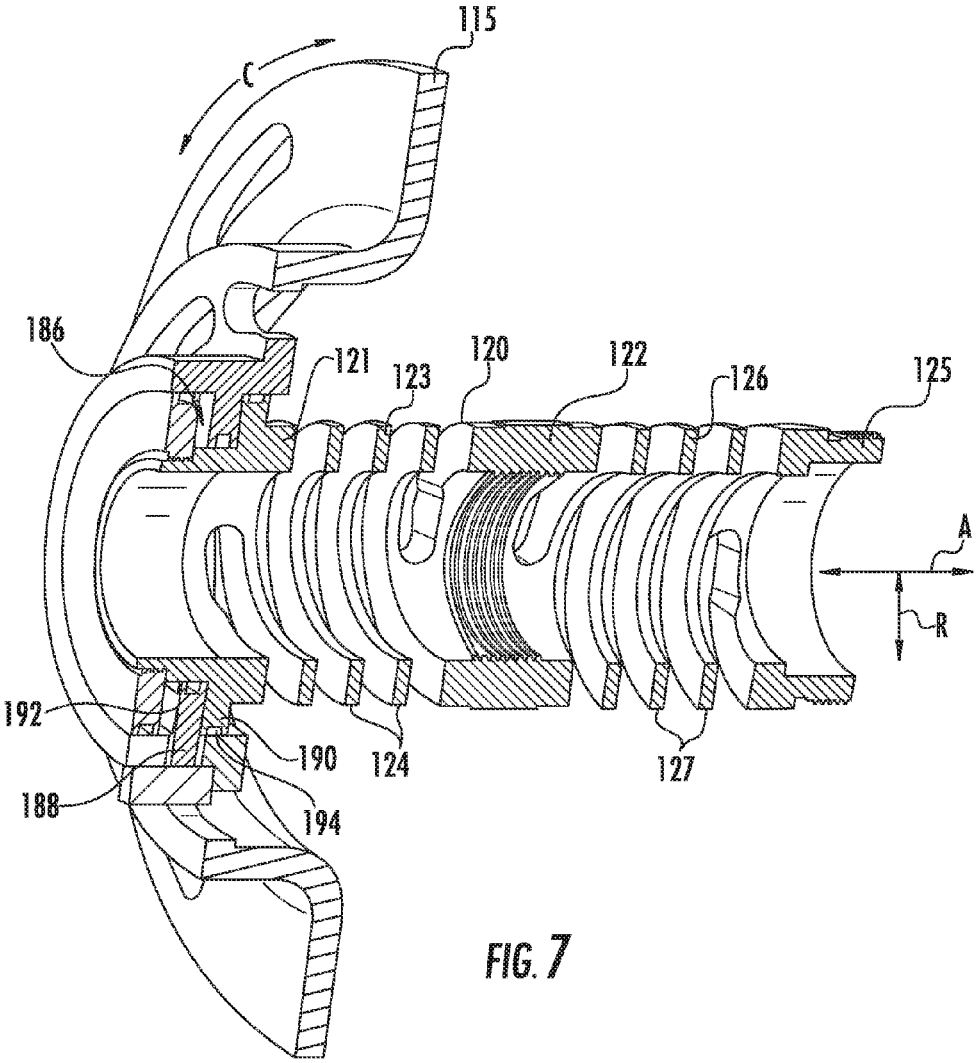
FIG. 7 provides a side section view of certain components of the exemplary linear compressor of FIG. 3.

FIG. 7 provides a side section view of certain components of linear compressor 100. As may be seen in FIG. 7, machined spring 120 includes a first cylindrical portion 121, a second cylindrical portion 122, a first helical portion 123, a third cylindrical portion 125 and a second helical portion 126. First helical portion 123 of machined spring 120 extends between and couples first and second cylindrical portions 121 and 122 of machined spring 120, e.g., along the axial direction A. Similarly, second helical portion 126 of machined spring 120 extends between and couples second and third cylindrical portions 122 and 125 of machined spring 120, e.g., along the axial direction A. Thus, second cylindrical portion 122 is suspended between first and third cylindrical portions 121 and 125 with first and second helical portions 123 and 126.

First and second helical portions 123 and 126 and first, second and third cylindrical portions 121, 122 and 125 of machined spring 120 may be continuous with one another and/or integrally mounted to one another. As an example, machined spring 120 may be formed from a single, continuous piece of metal, such as steel, or other elastic material. In addition, first, second and third cylindrical portions 121, 122 and 125 and first and second helical portions 123 and 126 of machined spring 120 may be positioned coaxially relative to one another, e.g., on the second axis A2.

First helical portion 123 includes a first pair of helices 124. Thus, first helical portion 123 may be a double start helical spring. Helical coils of first helices 124 are separate from each other. Each helical coil of first helices 124 also extends between first and second cylindrical portions 121 and 122 of machined spring 120. Thus, first helices 124 couple first and second cylindrical portions 121 and 122 of machined spring 120 together. In particular, first helical portion 123 may be formed into a double-helix structure in which each helical coil of first helices 124 is wound in the same direction and connect first and second cylindrical portions 121 and 122 of machined spring 120.

Second helical portion 126 includes a second pair of helices 127. Thus, second helical portion 126 may be a double start helical spring. Helical coils of second helices 127 are separate from each other. Each helical coil of second helices 127 also extends between second and third cylindrical portions 122 and 125 of machined spring 120. Thus, second helices 127 couple second and third cylindrical portions 122 and 125 of machined spring 120 together. In particular, second helical portion 126 may be formed into a double-helix structure in which each helical coil of second helices 127 is wound in the same direction and connect second and third cylindrical portions 122 and 125 of machined spring 120.

By providing first and second helices 124 and 127 rather than a single helix, a force applied by machined spring 120 may be more even and/or inner back iron assembly 130 may rotate less during motion of inner back iron assembly 130 along the second axis A2. In addition, first and second helices 124 and 127 may be counter or oppositely wound. Such opposite winding may assist with further balancing the force applied by machined spring 120 and/or inner back iron assembly 130 may rotate less during motion of inner back iron assembly 130 along the second axis A2. In alternative exemplary embodiments, first and second helices 124 and 127 may include more than two helices. For example, first and second helices 124 and 127 may each include three helices, four helices, five helices or more.

By providing machined spring 120 rather than a coiled wire spring, performance of linear compressor 100 can be improved. For example, machined spring 120 may be more reliable than comparable coiled wire springs. In addition, the stiffness of machined spring 120 along the radial direction R may be greater than that of comparable coiled wire springs. Further, comparable coiled wire springs include an inherent unbalanced moment. Machined spring 120 may be formed to eliminate or substantially reduce any inherent unbalanced moments. As another example, adjacent coils of a comparable coiled wire spring contact each other at an end of the coiled wire spring, and such contact may dampen motion of the coiled wire spring thereby negatively affecting a performance of an associated linear compressor. In contrast, by being formed of a single continuous material and having no contact between adjacent coils, machined spring 120 may have less dampening than comparable coiled wire springs.

Turning back to FIG. 5, first cylindrical portion 121 is mounted to casing 110 at first end portion 102 of casing 110. Thus, first cylindrical portion 121 is positioned at or adjacent first end portion 102 of casing 110. Third cylindrical portion 125 is mounted or fixed to casing 110 at second end portion 104 of casing 110, e.g., to cylinder assembly 111 of casing 110. Thus, third cylindrical portion 125 is positioned at or adjacent second end portion 104 of casing 110. Second cylindrical portion 122 is positioned at middle portion 119 of machined spring 120. In particular, second cylindrical portion 122 is positioned within and fixed to inner back iron assembly 130. Second cylindrical portion 122 may also be positioned equidistant from first and third cylindrical portions 121 and 125, e.g., along the axial direction A.

Third cylindrical portion 125 of machined spring 120 is mounted to cylinder assembly 111 at second end portion 104 of casing 110 via a screw thread of third cylindrical portion 125 threaded into cylinder assembly 111. In alternative exemplary embodiments, third cylindrical portion 125 of machined spring 120 may be welded, glued, fastened, or connected via any other suitable mechanism or method, such as an interference fit, to casing 110. It should be understood that the features described below may also be configured or adapted to move third cylindrical portion 125 of machined spring 120 in alternative exemplary embodiments.

Linear compressor 100 includes features for adjusting a length of machined spring 120, e.g., along the axial direction A. In particular, linear compressor 100 may include features for adjusting a position of first cylindrical portion 121 of machined spring 120 relative to third cylindrical portion 125 of machined spring 120. For example, as shown in FIGS. 5 and 6, first cylindrical portion 121 of machined spring 120 is selectively adjustable between a first position (shown in FIG. 5) and a second position (shown in FIG. 6). As may be seen in FIGS. 5 and 6, first cylindrical portion 121 is positioned further from third cylindrical portion 125, e.g., along the axial direction A, when first cylindrical portion 121 is positioned in the first position. Thus, the length of machined spring 120 is greater when first cylindrical portion 121 is positioned in the first position compared to when first cylindrical portion 121 is positioned in the second position.

To actuate first cylindrical portion 121 between the first and second positions, linear compressor 100 includes a conduit 180 and a valve 181 (shown schematically), such as a solenoid valve. Conduit 180 extends between an inlet 182 and an outlet 184. Inlet 182 of conduit 180 is positioned for receiving compressed discharge fluid from chamber 112 of cylinder assembly 111. As an example, inlet 182 of conduit 180 may be positioned downstream of discharge valve 117 in order to receive compressed discharge fluid. Outlet 184 of conduit 180 is positioned for directing the compressed discharge fluid into an enclosed volume or cavity 186. As an example, conduit 180 may be mounted to end cap 115 such that outlet 184 of conduit 180 is positioned at or adjacent enclosed cavity 186. When enclosed cavity 186 is filled with compressed discharge fluid, the compressed discharge fluid urges first cylindrical portion 121 of machined spring 120 from the first position towards the second position.

As may be seen in FIGS. 5 and 6, first cylindrical portion 121 of machined spring 120 is positioned at or adjacent end cap 115. In particular, first cylindrical portion 121 of machined spring 120 is coupled to end cap 115 such that first cylindrical portion 121 is movable between the first and second positions. For example, end cap 115 of casing 110 includes a flange 188, and machined spring 120 also includes a flange 190. Flange 188 of end cap 115 extends, e.g., along the radial direction R, from end cap 115 towards first cylindrical portion 121 of machined spring 120. Conversely, flange 190 of machined spring 120 extends, e.g., along the radial direction R, from machined spring 120 towards end cap 115. Flange 188 of end cap 115 and flange 190 of machined spring 120 assist with defining enclosed cavity 186 therebetween. Flange 188 of end cap 115 and flange 190 of machined spring 120 also assist with mounting machined spring 120 to casing 110, e.g., by hindering or preventing excessive motion of machined spring 120 along the axial direction A.

Linear compressor 100 also includes a first O-ring 192 and a second O-ring 194. First O-ring 192 extends between flange 188 of end cap 115 and first cylindrical portion 121 of machined spring 120, e.g., along the radial direction R.

Second O-ring 194 extends between flange 190 of machined spring 120 and end cap 115, e.g., along the radial direction R. First and second O-rings 192 and 194 assist with sealing enclosed cavity 186 and hindering or preventing leakage of compressed discharge fluid from enclosed cavity 186.

Using conduit 180, valve 181 and compressed discharge fluid, the length of machined spring 120, e.g., along the axial direction A, may be adjusted. In particular, the position of first cylindrical portion 121 of machined spring 120 relative to third cylindrical portion 125 of machined spring 120 may be adjusted with conduit 180, valve 181 and compressed discharge fluid. For example, the controller of linear compressor 100 may be configured for programmed for determining whether an operating condition of linear compressor 100 is a low capacity operating condition or a high capacity operating condition. In the low capacity operating condition, less fluid is compressed by piston 114 within chamber 112 compared to the high capacity operating condition, e.g., due to a stoke of piston 114 being smaller in the low capacity operating condition. The low capacity operating condition may correspond to a normal operating condition of linear compressor 100, e.g., when used in refrigerator appliance 10. Conversely, the low capacity operating condition may correspond to an operating condition of linear compressor 100 during initial startups or after defrosting operations, e.g., when used in refrigerator appliance 10.

The controller of linear compressor 100 may also be configured or programmed for activating the motor of linear compressor 100 in order to reciprocate a mover (e.g., inner back iron assembly 130) of linear compressor 100 within the stator of the motor). With the motor activated, piston 114 reciprocates within chamber 112 and compresses fluid therein. The controller of linear compressor 100 may also be programmed or configured for actuating valve 181 such that conduit 180 directs compressed discharge fluid into enclosed cavity 186, e.g., if the operating condition of linear compressor 100 is the low capacity operating condition. The compressed discharge fluid within enclosed cavity 186 urges first cylindrical portion 121 of machined spring 120 from the first position towards the second position. Such movement of first cylindrical portion 121 of machined spring 120 also reduces the length of machined spring 120, e.g., by moving first cylindrical portion 121 closer to third cylindrical portion 125 along the axial direction A.

As will be understood by those skilled in the art, a stoke of piston 114 within chamber 112 is smaller in the low capacity operating condition relative to the high capacity operating condition. By reducing the length of machined spring 120 while operating in the low capacity operating condition, a head clearance of piston 114 within chamber 112 can be reduced and an efficiency of linear compressor 100 can be improved. Conversely, the stoke of piston 114 within chamber 112 is larger in the high capacity operating condition relative to the low capacity operating condition. By increasing the length of machined spring 120 while operating in the high capacity operating condition, a head clearance of piston 114 within chamber 112 can be maintained without head crashing and an efficiency of linear compressor 100 can be improved during high capacity operating conditions. Thus, linear compressor 100 can operate efficiently in both the high and low capacity operating conditions by adjusting the length of machined spring 120 depending upon the operating condition of linear compressor 100.

While described in the context of linear compressor 100, it should be understood that the present subject matter may be used in any suitable linear compressor. For example, the present subject matter may be used in linear compressors with fixed or static inner back irons. In addition, the length of machined spring 120, and the position of first cylindrical portion 121 of machined spring 120 relative to third cylindrical portion 125 of machined spring 120 may be adjusted with other methods or mechanisms in alternative exemplary embodiments. In particular, linear compressor 100 may include a linear actuator for adjusting the length of machined spring 120 or the position of first cylindrical portion 121 of machined spring 120 relative to third cylindrical portion 125 of machined spring 120 rather than utilizing compressed discharge fluid in alternative exemplary embodiments. The linear actuator may include at least one of a ball screw, a roller screw, a screw jack, a pneumatic jack, and a hydraulic jack coupled to the machined spring 120 such that the linear actuator is operable to adjust the length of machined spring 120.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A linear compressor, comprising:

a cylinder assembly defining a chamber;

a piston slidably received within the chamber of the cylinder assembly;

a driving coil;

an inner back iron assembly positioned in the driving coil, the inner back iron assembly extending between a first end portion and a second end portion, the inner back iron assembly having an outer surface;

a magnet mounted to the inner back iron assembly at the outer surface of the inner back iron assembly such that the magnet faces the driving coil;

a machined spring comprising a first cylindrical portion positioned adjacent the first end portion of the inner back iron assembly;

a second cylindrical portion positioned within and fixed to the inner back iron assembly;

a first helical portion extending between and coupling the first and second cylindrical portions together;

a third cylindrical portion positioned adjacent the second end portion of the inner back iron assembly; and a second helical portion extending between and coupling the second and third cylindrical portions together;

an end cap having a flange, the first cylindrical portion of the machined spring positioned at the end cap, the machined spring having a flange positioned at the first cylindrical portion of the machined spring, the flange of the machined spring and the flange of the end cap defining an enclosed cavity therebetween; and a conduit having an inlet and an outlet, the inlet of the conduit positioned for receiving discharge fluid from the chamber of the cylinder assembly, the outlet of the conduit positioned for directing the discharge fluid from the chamber of the cylinder assembly into the enclosed cavity in order to adjust a position of the first cylindrical portion of the machined spring relative to the third cylindrical portion of the machined spring.

2. The linear compressor of claim 1, further comprising a first O-ring that extends between the flange of the end cap and the machined spring and a second O-ring that extends between the flange of the machined spring and the end cap.

3. The linear compressor of claim 1, wherein the cylinder assembly and the end cap are positioned opposite each other about the driving coil.

4. The linear compressor of claim 1, wherein the first cylindrical portion of the machined spring is selectively adjustable between a first position and a second position, the first cylindrical portion of the machined spring being positioned further from the third cylindrical portion of the machined spring in the first position.

5. The linear compressor of claim 1, wherein the first, second and third cylindrical portions and the first and second helical portions of the machined spring are continuous with one another.

6. The linear compressor of claim 1, wherein a magnetic field of the driving coil engages the magnet in order to move the inner back iron assembly in the driving coil and the piston within the chamber of the cylinder assembly during operation of the driving coil.

7. The linear compressor of claim 1, further comprising a flexible coupling extending between the inner back iron assembly and the piston.

8. A linear compressor defining a radial direction, a circumferential direction and an axial direction, the linear compressor comprising:

a cylinder assembly defining a chamber;

a piston received within the chamber of the cylinder assembly such that the piston is slidable along a first axis within the chamber of the cylinder assembly;

a machined spring;

an inner back iron assembly extending about the machined spring along the circumferential direction, the inner back iron assembly fixed to the machined spring at a middle portion of the machined spring;

a driving coil extending about the inner iron assembly along the circumferential direction, the driving coil operable to move the inner back iron assembly along a second axis, the first and second axes being substantially parallel to the axial direction;

a magnet mounted to the inner back iron assembly such that the magnet is spaced apart from the driving coil by an air gap along the radial direction;

an end cap having a flange, the flange extending towards the machined spring along the radial direction, the machined spring having a flange extending towards the end cap along the radial direction, the flange of the machined spring and the flange of the end cap defining an enclosed cavity therebetween; and a conduit having an inlet and an outlet, the inlet of the conduit positioned for receiving compressed discharge fluid from the chamber of the cylinder assembly, the outlet of the conduit positioned for directing the compressed discharge fluid from the chamber of the cylinder assembly into the enclosed cavity in order to adjust a length of the machined spring along the axial direction.

9. The linear compressor of claim 8, wherein the cylinder assembly and the end cap are positioned at opposite ends of the machined spring.

10. A method for operating a linear compressor, comprising:

activating a motor of the linear compressor in order to reciprocate a mover of the linear compressor within the motor, the mover suspended in the motor with a machined spring; and directing compressed discharge fluid from a cylinder of the linear compressor into an enclosed volume defined by the machined spring and a casing of the linear compressor, the compressed discharge fluid urging an end of the machined spring from a first position towards a second position, a length of the machined spring being a first length when the end of the machined spring is in the first position, the length of the machined spring being a second length when the end of the machined spring is in the second position, the first and second lengths being different.

11. The method of claim 10, further comprising establishing whether an operating condition of the linear compressor is a low capacity operating condition or a high capacity operating condition prior to said step of directing.

12. The method of claim 11, wherein the second length is less than the first length, wherein said step of directing comprises directing compressed discharge fluid from the cylinder into the enclosed volume if the operating condition of the linear compressor is the low capacity operating condition at said step of establishing.

13. The method of claim 10, wherein the mover is fixed to the machined spring at a middle portion of the machined spring.

* * * * *